US005133479A

United States Patent [19]

Boyte, Sr.

[11] Patent Number: 5,133,479

[45] Date of Patent: Jul. 28, 1992

[54] LIQUID CONTAINER WITH ORIENTED FLOATING STOPPER

[76] Inventor: James M. Boyte, Sr., Star Rte., Box 55-A, Carthage, N.C. 28327

[21] Appl. No.: 668,140

[22] Filed: Mar. 11, 1991

[51] Int. Cl.[5] ..... G01F 11/00

[52] U.S. Cl. ..... 222/1; 222/212; 222/563

[58] Field of Search ..... 222/1, 51, 206, 212, 222/213, 531, 563

[56] References Cited

U.S. PATENT DOCUMENTS

| | | | |
|---|---|---|---|
| 756,546 | 4/1904 | Benthuysen | 222/206 |
| 3,172,575 | 3/1965 | Vosburg | 222/185 |
| 3,256,977 | 6/1966 | Pettersen | 222/190 X |
| 3,366,285 | 1/1968 | Scislowicz | 222/383 |
| 4,696,328 | 9/1987 | Rhodes, Jr. | 141/1 |
| 4,789,082 | 12/1988 | Sampson | 222/1 |
| 4,842,152 | 6/1989 | Donegan | 215/294 |
| 4,846,378 | 7/1989 | Kim | 222/479 |
| 4,938,390 | 7/1990 | Markva | 222/206 |
| 5,000,353 | 3/1991 | Kostanecki et al. | 222/212 X |

*Primary Examiner*—Michael S. Huppert
*Assistant Examiner*—Joseph A. Kaufman
*Attorney, Agent, or Firm*—Cushman, Darby & Cushman

[57] ABSTRACT

A container for a liquid which is to be poured out of the container through an open neck, is internally provided with a buoyant stopper for the neck. The stopper is oriented, by uneven weight distribution, to float in a stop surface up, flexible tabs down orientation. In use, the container, after being opened, is slightly squeezed to elevate the stopper stop surface into sealing engagement with the neck. In this condition, the container is inverted and its open neck placed over the intended receiver, whereupon manual squeezing is relaxed, allowing the stopper to bob up towards the bottom of container. Inversion, while bobbing up desirably orients the stopper so that, as the stopper settles into the container shoulder or neck during emptying, it cannot undesirably replug the container neck. The stopper can be inserted into the container during the container manufacturing process, by flexing the tabs and forcing the stopper into the container through the neck, tab end first.

7 Claims, 2 Drawing Sheets

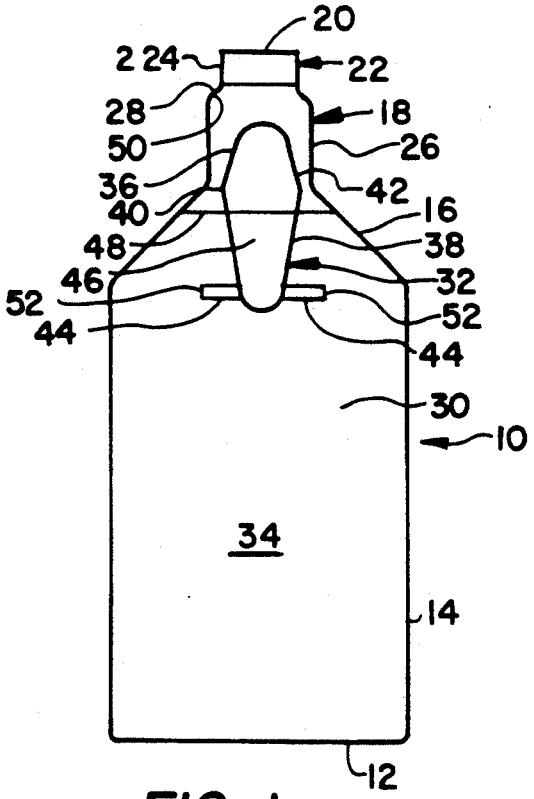
FIG. 1
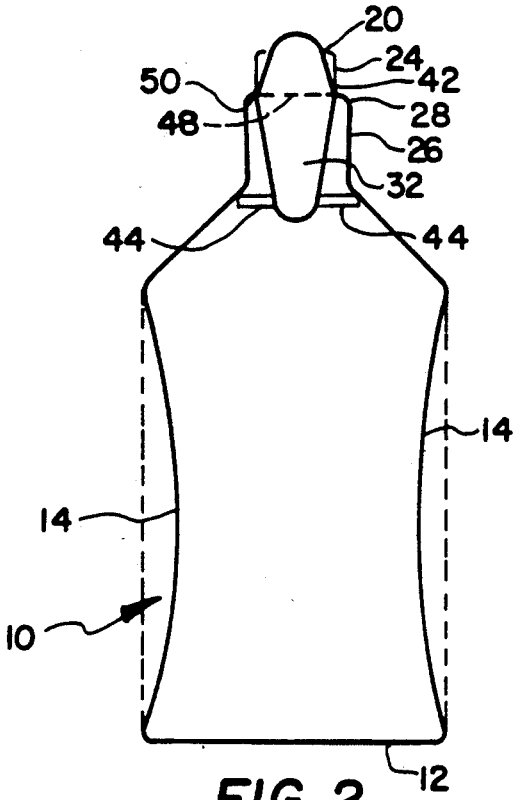
FIG. 2
FIG. 3
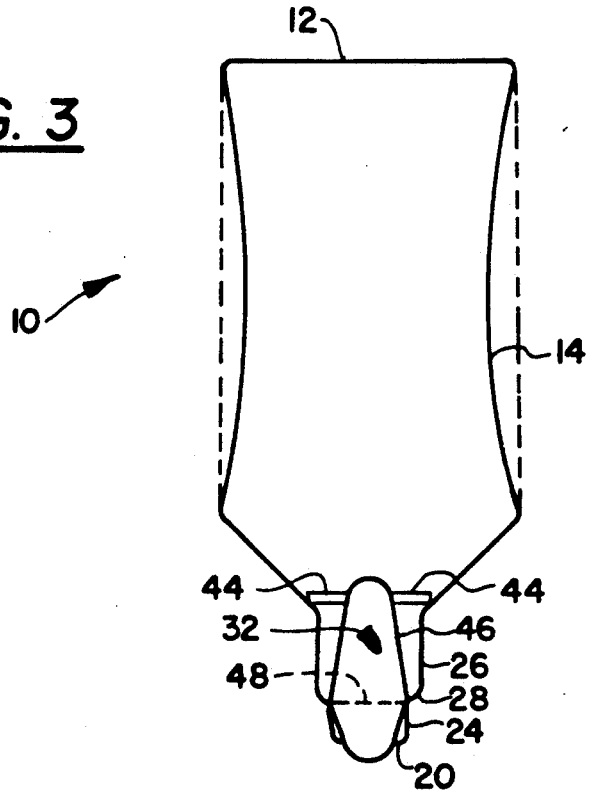

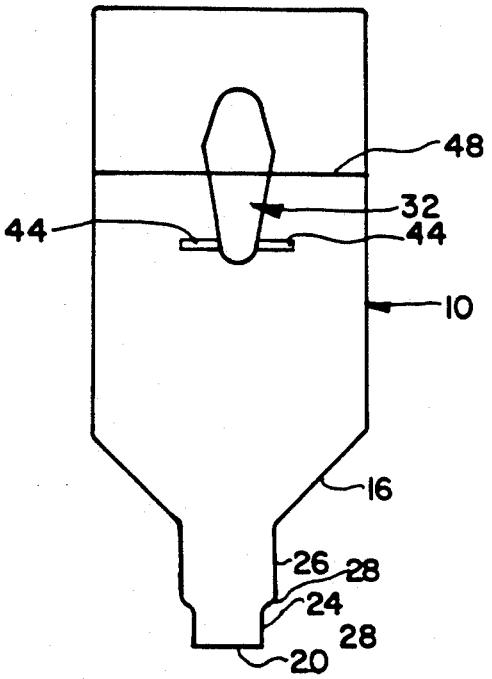
FIG. 4
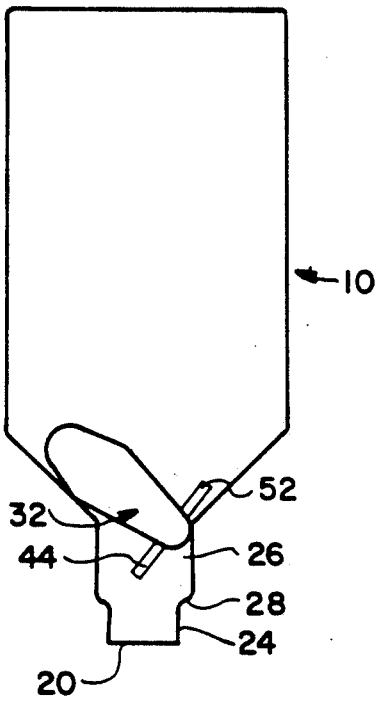
FIG. 5
FIG. 6
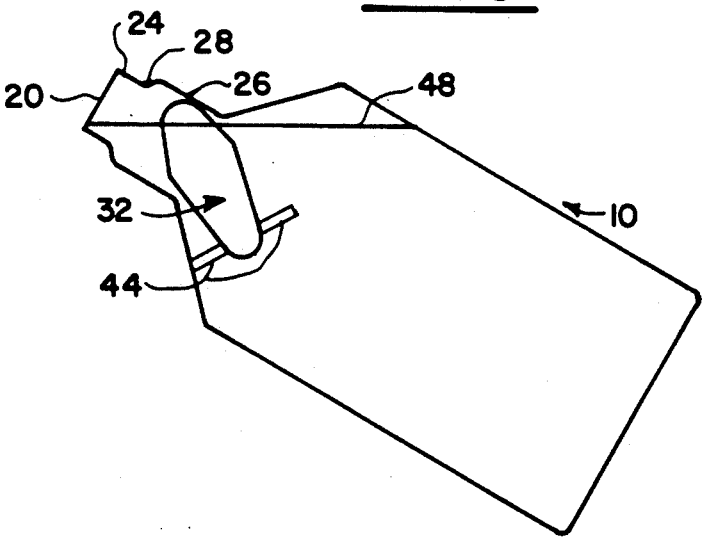

LIQUID CONTAINER WITH ORIENTED FLOATING STOPPER

BACKGROUND OF THE INVENTION

It is difficult, without spilling, to pour oil from a usual can, bottle or similar container into the filler inlet for an automotive engine oil reservoir, unless a funnel is used. That is because the container usually has a short neck (or no neck), the container usually is nearly completely full, and the vicinity of the filler inlet may be obstructed by other structures. In time of need, a funnel may not be available. This leads to undesirable spills and to an undue reluctance to give proper attention to adding oil to the engine.

Although engine oil is given as a ready example, there are other situations in which a comparable problem arises due to the difficulty of pouring a liquid, without spillage, from an open neck of a container, without the aid of a funnel.

SUMMARY OF THE INVENTION

A container for a liquid which is to be poured out of the container through an open neck, is internally provided with a buoyant stopper for the neck. The stopper is oriented, by uneven weight distribution, to float in a stop surface up, flexible tabs down orientation. In use, the container, after being opened, is slightly squeezed to elevate the stopper stop surface into sealing engagement with the neck. In this condition, the container is inverted and its open neck placed over the intended receiver, whereupon manual squeezing is relaxed, allowing the stopper to bob up towards the bottom of container. Inversion, while bobbing up, desirably orients the stopper so that, as the stopper settles into the container shoulder or neck during emptying, it cannot undesirably replug the container neck. The stopper can be inserted into the container during the container manufacturing process, by flexing the tabs and forcing the stopper into the container through the neck, tab end first.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 1 is a somewhat schematic longitudinal sectional view of a container, full of liquid, on the upper surface of which is floating a buoyant, oriented stopper provided on axially opposite ends with a stop surface and a set flexible tabs, in accordance with principles of the present invention;

FIG. 2 is a similar view, showing the stopper in neck-plugging condition due to transverse squeezing of the container body after the container cap has been opened;

FIG. 3 is a similar view, showing the container still squeezed, but after inversion, with the stopper still plugging the neck;

FIG. 4 is a similar view, showing how the stopper bobs upward toward the bottom of the inverted container, thus opening the container mouth, and inverts, upon discontinuation of transverse squeezing of the container body;

FIG. 5 is a similar view showing how, as the container empties of liquid through the mouth of its open neck, the tabs prevent the stopper from reclosing the neck; and FIG. 6 shows how liquid may be conventionally poured from the container, if desired, without performing the temporary plugging step that is illustrated in FIGS. 2 and 3.

DETAILED DESCRIPTION

A container is illustrated at 10 in FIG. 1. In the preferred embodiment, the container is a one-quart container for automotive engine oil, e.g., blow molded out of polyethylene or polypropylene. (In fact, the size and/or contents may be different.) Typically, although not essentially, the container 10 is circular in transverse cross-sectional shape, although it need not be. It is shown having a bottom wall 12, an upstanding outer peripheral sidewall 14, an upper end wall, preferably in the form of an upwardly tapering shoulder 16 at the upper end of the sidewall, and a tubular neck 18, having an open end 20. The mouth 20 at the end of the neck is preferably suitably openably closed by a seal cap 22 or other closure, which may be designed to be screwed off, twisted-off, pushed, twisted or pulled open, pierced, broken, pried-off, cut-off, or otherwise manipulated for opening the neck at the mouth.

The neck 18, between its axially inner and outer ends, has a structural feature which effectively provides a constriction in internal diameter, as experienced in the direction of outflow of liquid from the container through the neck. Thus, the neck has a minimum internal diameter at 24, axially outwardly of constriction, which is greater than its minimum internal diameter at 26, axially inwardly of the constriction. The constriction 28 may take the form of an abrupt step-down in the internal diameter of the neck at a frusto-conical band, so that the neck has a smaller internal diameter above than below the band.

Contained within the internal cavity 30 of the container 10, is a buoyant stopper 32 (also known as a floater). The floating stopper 32 is a structure which is differentially buoyant along a longitudinal axis, so that it has a remarked tendency to float on the surface of a liquid 34 contained in the cavity 30 with one end up, and an opposite end down. The floating stopper preferably has the shape that is illustrated in the drawing figures, including a body of revolution, elongated about its longitudinal axis, each end being bluntly conical, with the upper, less-dense end 36 tapering at a greater angle to the longitudinal axis than does the lower, more-dense end 38.

The upper end is preferably axially shorter than the lower end, by being more blunt. Thus, at the intersection of (or between) the upper and lower end portions, the floating stopper 32 has an encircling region 40 of maximum external diameter, which, on the upper portion 36, provides a tapered circumferential sealing surface 42.

The relative sizes and shapes of the stopper and neck are such that the sealing surface 42 is capable of circumferentially sealing off from the cavity 30, the smaller diameter portion 24 of the neck 18 at the constriction 28.

The lower portion 38 of the stopper 32 is shown provided with two or more laterally projecting tabs 44. Preferably, the tabs 44 are made of resiliently flexible material, so that the stopper 32 can be inserted in the cavity 30 by temporarily condensing, bending or flexing the tabs against the body of the stopper, and inserting the stopper 32 through the open neck 18, into the cavity 30. This is preferably done before the container is filled with liquid.

If the stopper body has a maximum external diameter that is larger than the minimum internal diameter of the neck at the constriction 28, a proper technique must be used for inserting the stopper into the cavity.

This can be done by application of moderate force axially on the stopper, e.g., much as one can force the cork on a wine bottle down into the bottle despite the fact that the cork is force fit in the bottle neck because its free outer diameter is larger than the internal diameter of the bottle neck. In that case, resilience of the stopper body is a key to proper installation. Thus, the stopper in the instance of the present invention may be made of traditional resilient bottle stopper material, such as cork, and cork substitutes such as foamed plastic and rubber. Of course, it should be made of material that is carefully selected not to adversely react with or contaminate the liquid which is to be contained in the container, nor to be susceptible to destructive decomposition therein, e.g., due to fermentation, oxidation or other attack by chemicals or micro-organisms.

If the stopper 32 is molded of synthetic plastic resin, its body 46 can be foamed, and its tabs 44 integrally molded with the body, but nonfoamed, so as to provide the lower portion 38 with a greater density. Alternatively, the body 46 may be foamed, and a nonfoamed flexible element of plastic material pierced transversally through the body 46 to provide the tabs 44.

In any event, when the container containing the stopper 32 is conventionally filled with liquid to a usual level, the stopper 32 floats on the surface 48 of the liquid 34. The degree to which the stopper is partially submerged in the liquid, of course depends on the density of the stopper relative to the liquid. The preferred situation is as depicted, e.g., the stopper 32 floats with the maximum diameter region 40 at or above the surface 48, with the upper portion 36 nosed into the larger diameter portion 26 of the neck, with the stopper's sealing surface 42 located generally coaxially with, but spaced axially below the axially downwardly facing seat 50 provided on the constriction 28.

If a person wishes to pour all of the liquid contents of cavity 30 into an engine oil intake (or other receiver) using a preferred method according to the present invention, the person, while holding the container 10 upright, or nearly upright, opens the closure 22, and then transversally squeezes the sidewall 14 of the container (e.g., as depicted in FIG. 2). The squeezing action (because the container is resilient or at least flexible-walled) reduces the volume in the cavity of the container, thereby causing the level of the surface 48 to rise towards, into or in the neck, towards the mouth 20. Accordingly, the stopper 32 rises, causing the sealing surface 42 to move axially into surface to surface circumferential sealing engagement with the annular seat 50, thereby effectively reclosing the neck 18 of the container.

By preference, as shown, the squeezing of the container sidewall 14 is accomplished by a person, e.g., with one or both hands, grippingly engaging the sidewall at two generally diametrically opposed locations, and squeezing these locations towards one another.

With the container sidewall so-squeezed, and the stopper thereby elevated into mouth-blocking relation in the neck 18, the person inverts the container (FIG. 3). The length of the stopper from the sealing surface 42 to the tabs 38, relative to the length of the container from the seal 50 to the region of the junction of the shoulder 16 with the neck 18 is such (taking also into account the flexibility of the tabs 38), that the sealed condition can be provided at 42/50 without such condition being prevented by the engagement of the tabs 38 with the shoulder 16 adjacent the juncture of the shoulder 16 with the neck 18.) The user then places the mouth 20 over the intended receiver, then somewhat relaxes his or her squeezing grip on the sidewall. Upon resulting release of hydrostatic pressure on the rear of the stopper from within the cavity, the buoyancy of the stopper causes the stopper to bob upwards to the bottom of the container, inverting as it moves (FIG. 4). (For this reason, the diameter, or width, of the container cavity, in the body of the container, must be longer than the effective top-to-bottom axial length of the stopper. Now, the container mouth 20 is open for the outflow of liquid 34, and the liquid upper surface 48 faces the container bottom wall 12 (i.e., the "headspace" of the cavity 30) is contiguous with the bottom wall 12 of the container, and the stopper part having the tabs 44 is oriented axially towards the juncture of the container neck 18 with the shoulder 16.

As liquid drains out of the mouth 20, the liquid level 48, and therefore, the floating stopper 32, descend towards the container mouth. However, before the stopper lower end can descend far enough into the container neck as to plug the neck and thus the mouth of the container, the outer ends 52 of the tabs 44 engage the shoulder 16 (the effective width of the tab structure, from end 52 to end 52 being greater than the diameter of the base of the neck), so that the liquid can continue to drain out of the mouth of the container until the container is empty.

In practice, the exterior of the container would likely be provided with a set of graphics and verbal instructions showing and explaining how to use the technique which has been explained above with reference to FIGS. 1-5.

Of course, despite the presence of the floating stopper in the container, the container could be opened and conventionally partially or completely emptied of its contents, as illustrated in FIG. 6. In such cases, the construction of the floating stopper relative to the container prevents the stopper from plugging the container mouth (other than intentionally) by practicing the steps illustrated in FIGS. 2 and 3 while the container remains sufficiently full of liquid.

Also, it is possible to use the container 10 for shuttling liquid to a receiver, since, once it has been emptied, it can simply be conventionally refilled, and the procedure explained above repeated.

Although, in the preferred embodiment, the container neck is of an internal diameter that is smaller than the maximum diameter of the stopper at 40 due to the as-molded dimensions of these two parts, it would be within the concept of the invention to apply to the neck (after the stopper has been inserted in the cavity) a structure (such as a thermally welded-in-place ring) that constricts the neck, or to make the stopper, or an encircling ring on the stopper out of a material that expands or swells after the stopper is in place (e.g., due to slow recovery of an elastic compression of a foamed plastic material).

It should now be apparent that the liquid container with oriented floating stopper as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A container for containing and dispensing a liquid, comprising:

a bottom wall, connected with a resilient sidewall, connected with a shoulder through which emerges a neck having a mouth and an internal annular constriction, defining within the container a cavity for containing a supply of liquid so that the liquid has an upper surface within the cavity;

a stopper disposed with the cavity and arranged, when said supply of liquid is contained within said cavity, to float on said surface of said liquid; said stopper having a less dense end and a more dense end so that said stopper tends to float on said liquid with said less dense end up and said more dense end down; an encircling annular sealing surface provided on said less dense end of said stopper, said sealing surface being arranged, upon sufficient squeezing of said sidewall while said container is upright with said mouth open, to be urged by hydrostatic pressure into circumferential sealing engagement with said annular constriction; and said more dense end having a tab structure projecting transversally outwards sufficiently for preventing said stopper, when floating in said liquid in said cavity when said container is inverted so as to be oriented bottomupwards, from fully obstructing egress of the liquid from said cavity through said mouth.

2. The container of claim 1, wherein:

said container is integrally molded of synthetic plastic resin and said constriction is constituted by an abrupt reduction in internal diameter of said neck.

3. The container of claim 1, wherein:

said sidewall, in said cavity, has an internal diameter which is greater than the effective end-to-end length of said stopper.

4. The container of claim 1, wherein:

said stopper comprises a body of foamed plastic material and said tab structure comprises at least two tabs projecting transversally outwards from said body.

5. The container of claim 4, wherein:

said two tabs are integrally formed with said body as nonfoamed regions of plastic material.

6. The container of claim 4, wherein:

said two tabs are constituted as opposite end portions of a rod pierced laterally through said body.

7. A method for pouring liquid contents from a cavity of a container having a bottom connected with a resilient sidewall connected with a shoulder through which emerges a neck having a mouth and an internal angular constriction, comprising:

(a) providing the cavity with a filling of liquid having an upper surface, and a stopper floating on said surface of the liquid with a less dense end up and a more dense end down, the stopper having on said less dense end an annular sealing surface capable of sealing with said annular constriction and having on said more dense end a tab structure capable when said more dense end is oriented towards said neck of preventing said stopper from completely occluding said neck;

(b) with said container oriented bottom down, neck up and said mouth open, squeezing said sidewall and thereby elevating said liquid surface and thus said stopper, causing said annular sealing surface to seal with said annular constriction;

(c) while maintaining said sidewall squeezed, inverting said container and juxtaposing said mouth over an intended receiver for the liquid; and (d) relaxing said squeezing, so that the stopper bobs upwards towards the bottom of the container, inverting as it goes, so that the more dense end of the stopper is oriented towards where the container neck emerges through said shoulder, and said liquid pours from said cavity, through said neck and out of said mouth.

* * * * *